US006142120A

United States Patent [19]

Biester et al.

[11] Patent Number: 6,142,120

[45] **Date of Patent: *Nov. 7, 2000**

[54] PROCESS AND DEVICE FOR CONTROLLING AN INTERNAL COMBUSTION ENGINE

[75] Inventors: Juergen Biester, Boeblingen; Andreas Kellner, Moeglingen, both of Germany

[73] Assignee: Robert Bosch GmbH, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/772,205

[22] Filed: Dec. 20, 1996

[30] Foreign Application Priority Data

Dec. 22, 1995 [DE] Germany ..... 195 48 278

[51] Int. Cl.[7] ..... F02M 37/04

[52] U.S. Cl. ..... 123/456; 123/458; 123/446

[58] Field of Search ..... 123/497, 506, 123/458, 357, 456, 446, 436

[56] References Cited

U.S. PATENT DOCUMENTS

| | | | |
|---|---|---|---|
| 4,248,194 | 2/1981 | Drutchas | 123/497 |
| 4,357,662 | 11/1982 | Schira | 123/436 |
| 4,539,956 | 9/1985 | Hengel | 123/436 |
| 4,565,173 | 1/1986 | Oshiage | 123/458 |
| 4,884,545 | 12/1989 | Mathis | 123/446 |
| 5,085,193 | 2/1992 | Morikawa | 123/497 |
| 5,261,366 | 11/1993 | Regueiro . | |
| 5,284,119 | 2/1994 | Smitley | 123/497 |
| 5,404,855 | 4/1995 | Yen | 123/446 |
| 5,425,342 | 6/1995 | Ariga | 123/456 |
| 5,471,959 | 12/1995 | Sturman | 123/497 |
| 5,598,817 | 2/1997 | Igarashi | 123/456 |
| 5,738,063 | 4/1998 | Pfuhl | 123/456 |
| 5,785,021 | 7/1998 | Yudanov | 123/446 |

FOREIGN PATENT DOCUMENTS

| | | |
|---|---|---|
| 0 643 219 | 3/1995 | European Pat. Off. . |
| 2 284 908 | 6/1995 | United Kingdom . |

*Primary Examiner*—Carl S. Miller
*Attorney, Agent, or Firm*—Kenyon & Kenyon

[57] ABSTRACT

A process and a device for controlling an internal combustion engine having high-pressure injection, in particular for an internal combustion engine having a common rail system. The fuel is delivered by at least one pump from a low-pressure area into a high-pressure area. A pressure sensor detects the fuel pressure prevailing in the high-pressure area. At least one first and one second final controlling element are provided for influencing the fuel pressure prevailing in the high-pressure area.

19 Claims, 2 Drawing Sheets

140
135
136
131
130
100
125
120
140
110
115
105

200
205
QK
210
QSV
PI
140
PI
PS
225
QSR
220
215
NIE
240
NIE
230
NSE
235
245
UEKP
110
PS
250
IS
255
UDRV
265
135
IDRV
260

PROCESS AND DEVICE FOR CONTROLLING AN INTERNAL COMBUSTION ENGINE

BACKGROUND INFORMATION

In motor vehicles having internal combustion engines, fuel is delivered with the aid of an electric fuel pump or a mechanical fuel pump out of a fuel tank and supplied via fuel lines to injectors. In internal combustion engines having high-pressure injection, particularly in self-ignition internal combustion engines, the electric fuel pump is coupled to another pump which produces a very high pressure in a high-pressure area of the fuel supply. The high-pressure area communicates with the injectors. Furthermore, a pressure-regulating valve is provided, which aids in regulating the pressure in the high-pressure area.

Given a process and a device for controlling an internal combustion engine, the underlying object of the present invention is to achieve a cost-effective and fast-acting regulation of the pressure prevailing in the high-pressure area.

SUMMARY OF THE INVENTION

The present invention provides a cost-effective procedure for regulating the pressure prevailing in the high-pressure area of a fuel-metering device. In addition, the fuel can be adapted very quickly to changing setpoint values.

DETAILED DESCRIPTION

Figure 1:
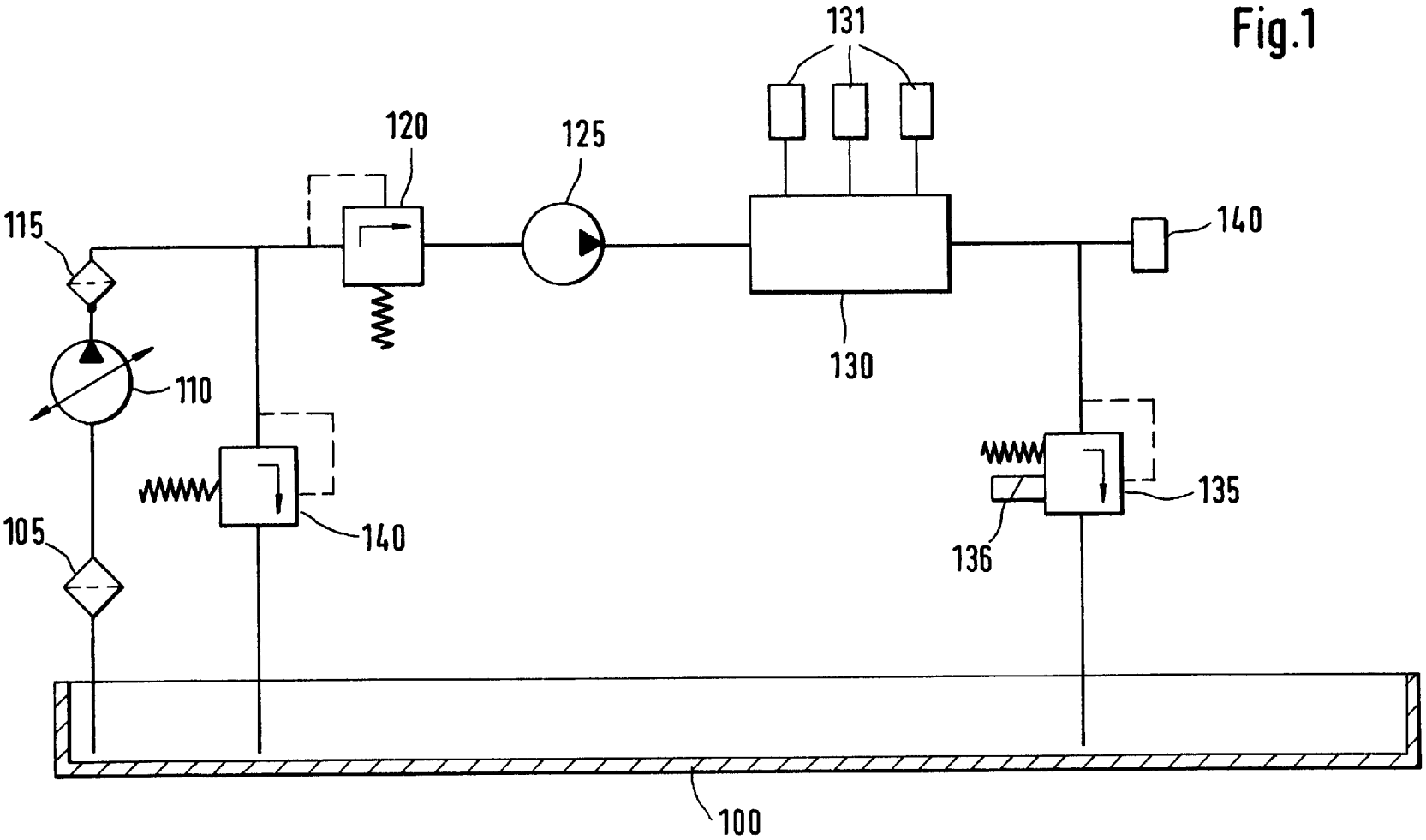
FIG. 1 shows a block diagram of the device for controlling an internal combustion engine according to the present invention.

FIG. 1 depicts those components of a fuel-supply system of an internal combustion engine having high-pressure injection which are necessary for an understanding of the present invention. The illustrated system is usually described as a common rail system.

A fuel-supply tank is denoted by 100. It communicates via a first filter 105 with a controllable auxiliary fuel-supply pump 110 and a second filter means 115. From the second filter means 115, the fuel arrives via a line at a valve 120. The conduit means between filter means 115 and valve 120 is connected via a low-pressure relief valve 140 with fuel-supply tank 100. Valve 120 communicates via a high-pressure pump 125 with a rail 130. The rail is-in contact via fuel lines with various injectors 131. Rail 130 is connectible by way of a pressure-regulating valve 135 to fuel-supply tank 110. Pressure-regulating valve 135 is controllable by means of a coil 136.

The lines between the output of high-pressure pump 125 and the input of pressure-regulating valve 135 are characterized as the high-pressure area. In this area, the fuel is under a high pressure. The pressure prevailing in the high-pressure area is detected by means of a sensor 140.

The functioning of this device is as follows: The fuel contained in the fuel-supply tank is delivered by the auxiliary fuel-supply pump 110 through filter means 105 and 115. On the output side of auxiliary fuel-supply pump 110, the fuel is pressurized with a pressure between about 1 and 3 bars. When the pressure prevailing in the low-pressure area of the fuel-supply system reaches a specifiable pressure, valve 120 opens and the input of high-pressure pump 125 is pressurized with a specific pressure. This pressure depends on the design of valve 120. Customarily, valve 120 is constructed so that, in response to a pressure of about 1 bar, the valve releases the connection to high-pressure pump 125.

If the pressure prevailing in the low-pressure area rises to unacceptably high values, then low-pressure relief valve 140 opens and releases the connection between the output of auxiliary fuel-supply pump 110 and fuel-supply tank 100. Valve 120 and low-pressure relief valve 140 hold the pressure prevailing in the low-pressure area to values between about 1 and 3 bars.

High-pressure pump 125 delivers the fuel from the low-pressure area into the high-pressure area. High-pressure pump 125 builds up a very high pressure in rail 130. This pressure lies on the order of magnitude of about 1000 to 2000 bars. By way of injectors 131, the fuel can be metered under a high pressure into the individual cylinders of the internal combustion engine.

Sensor 140 detects the pressure prevailing in the rail or in the entire high-pressure area. The pressure prevailing in the high-pressure area is able to be regulated by pressure-regulating valve 135, which can be driven by a coil 136. Pressure-regulating valve 135 opens in response to different pressure values as a function of the voltage being applied to coil 136 or of the current flowing through coil 136.

It is customary to use an electric fuel pump having a DC motor or an electrically commutated DC motor (EC motor) as an auxiliary fuel pump 110. For higher delivery capacities, especially as required in commercial vehicles, it is also possible to employ a plurality of auxiliary fuel-supply pumps connected in parallel. In such cases, EC-motors are preferably used in order to provide longer service life and less down time.

Two final controlling elements are used to regulate the pressure P prevailing in the high-pressure area. These are, first of all, the electric auxiliary fuel-supply pump 110, whose delivery capacity is adjustable, and pressure-regulating valve 135. Pressure-regulating valve 135 can also be described as a relief valve since it releases the connection between the high-pressure area and the low-pressure area in response to an adjustable pressure.

Figure 2:
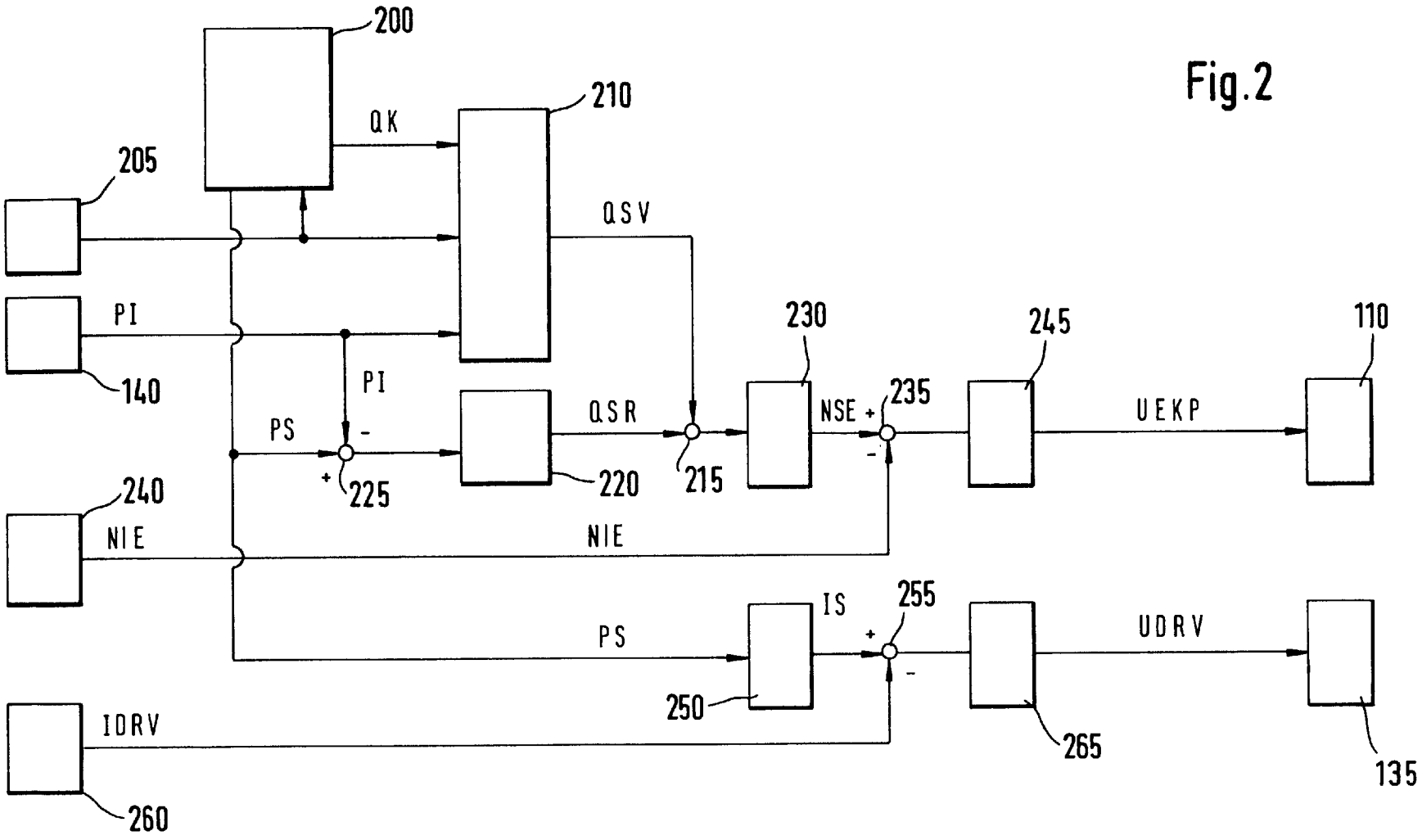
FIG. 2 shows a detailed flow chart of the regulating device of the process for controlling an internal combustion engine according to the present invention.

The regulator structure is shown in FIG. 2 as a block diagram. Elements already described in FIG. 1 are denoted by corresponding reference symbols. 200 designates a controller, which applies signals to a pilot controller 210, as well as to a current controller 250. The output signal N of a rotational speed sensor 205 is fed to controller 200 and to pilot controller 210. Output signal PI of pressure sensor 140 arrives at pilot controller 210 and at an interconnection point 225. Output signal QSV of pilot controller 210 arrives at an interconnection point 215.

A signal PS, which corresponds to the desired setpoint pressure in rail 130, is applied to the second input of interconnection point 225. This signal PS is made available by controller 200. The output signal of interconnection point 225 arrives at a pressure regulator 220 whose output signal QSR arrives, in turn, at the second input of interconnection point 215. A setpoint selection unit 230 receives the output signal from interconnection point 215. This setpoint selection unit specifies a setpoint value NSE for the rotational frequency of auxiliary fuel-supply pump 110. This setpoint value NSE arrives at an interconnection point 235, at whose second input is applied a negative operational sign of the output signal NIE of a speed of rotation sensor 240 which detects the rotational speed of auxiliary fuel-supply pump 110. The output signal of interconnection point 235 arrives at a speed controller 245 which applies a corresponding drive signal UEKP to auxiliary fuel-supply pump 110.

Signal PS arrives furthermore at a current controller 250, which specifies a setpoint value IS for the current which flows through pressure-regulating valve 135. This setpoint value IS arrives at an interconnection point 255, at whose second input is applied a negative operational sign of the output signal IDRV of a current-measuring unit 260. The output signal of interconnection point 255 arrives at a current controller 265, which applies a drive signal UDRV to regulating valve 135.

Auxiliary fuel-supply pump 110 can also be described as a first final controlling element, and pressure-regulating valve 135 can also be described as a second final controlling element.

The functioning of this device is as follows: pilot controller 210 specifies signal QSV as a function of active injection quantity QK, which is made available by controller 200, of engine speed N of the internal combustion engine, and of the pressure PI prevailing in rail 130. This signal is a measure of the volume that has to be delivered by the auxiliary fuel-supply pump to meet the injection requirements. In this case, the approximate known pressure-dependent leakage and the pressure and engine-speed-dependent efficiency factor of the high-pressure pump are taken into consideration, and described as pilot-control mass flow QSV. In addition, in dependence upon the desired rail pressure PS and the actual pressure PI prevailing in the rail, interconnection point 225 determines a pressure difference. This pressure difference between the expected and actual value is supplied to pressure regulator 220. This pressure regulator 220 determines a first drive value QSR on the basis of the deviation between the expected and actual value. This first drive value QSR and the second drive value QSV, which are specified by pilot controller 210, are gated cumulatively at interconnection point 215.

As a function of this value, the setpoint-value calculation unit 230 calculates a setpoint value NSE for the rotational speed of auxiliary fuel-supply pump 110. Interconnection point 235 compares this rotational speed value with the actual value NIE of the rotational speed of the auxiliary fuel-supply pump. In dependence upon the deviation between the expected value NSE and the actual value NIE of the rotational speed of auxiliary fuel-supply pump 110, speed controller 245 determines a drive signal to be received by the first final controlling element 110.

The position sensor used in EC motors, particularly for electrical commutation purposes, can be used as a rotational speed sensor to evaluate rotational frequency NIE.

One simplified specific embodiment eliminates the need for the speed control loop. Merely the auxiliary fuel-supply pump is controlled in this case. This means that setpoint selection unit 230 emits the drive signal UEKP for auxiliary fuel-supply pump 110 directly.

As an alternative to auxiliary fuel-supply pump 110, another final controlling element can also be used to influence the delivery quantity in the low pressure area. For example, valve 140 can be conceived similarly to valve 135 as a pressure-regulating valve and driven to control the delivery quantity. In addition, a shutoff valve can also be arranged in the low-pressure area to control the fuel flow there.

Long-term pressure changes in the rail can be compensated by superposing pilot-control value QSV and output signal QSR of pressure regulator 220.

On the basis of this procedure, in response to a constant setpoint pressure, a corresponding average rail pressure is produced. In response to increases in the setpoint pressure, the fuel-flow controller adjusts a setpoint mass flow rate QSR, causing the rail pressure to rise. In response to reductions in the setpoint pressure, the flow-rate controller decreases the setpoint mass flow rate QSR to zero. If this measure does not suffice to make the requisite pressure reduction, pressure-regulating valve 135 is used. Its opening pressure is adjusted by varying the current flowing through coil 136 to open in response to about 20 to 50 bar over the setpoint pressure.

At this point, if the pressure prevailing in the rail drops off too slowly in spite of less delivery through auxiliary fuel-supply pump 110, control unit 250 specifies a current IS which causes pressure-regulating valve 135 to open, and the pressure is thereby reduced until a pressure value somewhat above setpoint pressure is reached. The pressure stays only for a short while above the expected rail pressure since the pressure continues to fall as the result of leakage and injections and the flow-rate control intervenes again by way of auxiliary fuel-supply pump 110.

Current I, which flows through coil 136 of valve 135, is preferably regulated. By this means, the resistance of solenoid coil 136, which varies with heat, can be compensated for on the basis of changing temperatures.

In the event of system errors, pressure-regulating valve 135 can be used as an emergency valve to rapidly reduce the pressure P prevailing in the rail.

This procedure offers the following advantages: the operating energy input required by the high-pressure pump is lower as necessitated by the smaller delivery quantities required which in turn economizes fuel; there is less tendency for fuel to heat up because of small return volumes; the leakage detection procedure can be simplified because the pressure-regulating valve 135 is nearly constantly closed; an improved dynamic performance is attained during pressure reduction; and a rapid pressure reduction is possible especially in response to an error.

What is claimed is:

1. A process for controlling an internal combustion engine having a high pressure injection, comprising the steps of:

delivering fuel to a low-pressure area with a first pump;

delivering the fuel from the low-pressure area to a high-pressure area with a second pump;

regulating a fuel pressure of the fuel with a final controlling element and a pressure-regulating valve, the final controlling element being arranged in the low-pressure area and influencing a delivery quantity of the fuel in the low-pressure area, the pressure-regulating valve being arranged in the high-pressure area;

applying a first drive signal to the final controlling element, the first drive signal being provided as a function of at least a fuel quantity to be injected; and applying a second drive signal to the pressure-regulating valve, the second drive signal being provided as a function of a comparison between an actual pressure value and a predetermined pressure value, wherein the final controlling element effects a closed loop control of the fuel pressure, and wherein the pressure-regulating valve effects an open loop control of the fuel pressure.

2. The process according to claim 1, wherein the final controlling element includes an electric fuel pump, and further comprising the step of:

specifying a setpoint value for regulating a rotational frequency of the electric fuel pump as a function of a first drive value and a second drive value.

3. The process according to claim 2, wherein the pressure-regulating valve directly regulates the fuel pressure, and further comprising the step of:

specifying a setpoint value for regulating a current which flows through the pressure-regulating valve as a function of a setpoint value of the fuel pressure.

4. The process according to claim 3, wherein the internal combustion engine has a common rail system.

5. The process according to claim 1, wherein the final controlling element and the pressure-regulating valve influence the fuel pressure simultaneously.

6. A device for controlling an internal combustion engine having a high-pressure injection, comprising:

a first pump delivering fuel to a low-pressure area;

a second pump delivering the fuel from the low-pressure area to a high-pressure area;

a final controlling element being arranged in the low-pressure area and influencing a delivery quantity of the fuel in the low-pressure area; and a pressure-regulating valve situated in the high-pressure area and regulating a fuel pressure of the fuel wherein the final controlling element effects a closed loop control of the fuel pressure, and wherein the pressure-regulating valve effects an open loop control of the fuel pressure.

7. The device according to claim 6, wherein the internal combustion engine has a common rail system.

8. The device according to claim 6, wherein the final controlling element operates simultaneously with the pressure-regulating valve.

9. The process according to claim 12, wherein the final controlling element includes a high-pressure pump.

10. The process according to claim 1, wherein the final controlling element includes a high-pressure pump.

11. The device according to claim 6, wherein the final controlling element includes a high-pressure pump.

12. A process for controlling an internal combustion engine having a high pressure injection, comprising the steps of:

delivering fuel to a low-pressure area with a first pump;

delivering the fuel from the low-pressure area to a high-pressure area with a second pump; and regulating a fuel pressure of the fuel with a final controlling element and a pressure-regulating valve, the final controlling element being arranged in the low-pressure area and influencing a delivery quantity of the fuel in the low-pressure area, the pressure-regulating valve being situated in the high-pressure area, wherein the final controlling element effects a closed loop control of the fuel pressure, and wherein the pressure-regulating valve effects an open loop control of the fuel pressure.

13. The process according to claim 12, wherein the final controlling element includes an electric pump.

14. The process according to claim 12, further comprising the step of:

applying a first drive signal to the final controlling element, the first drive signal being determined as a function of at least a fuel quantity to be injected.

15. The process according to claim 12, further comprising the step of:

applying a second drive signal to the pressure-regulating valve, the second drive signal being determined as a function of a comparison between an actual pressure value and a predetermined pressure value.

16. The process according to claim 12, further comprising the steps of:

applying a first drive signal to the final controlling element;

applying a second drive signal to the pressure-regulating valve; and specifying a setpoint value for regulating a rotational frequency of the final controlling element as a function of a first drive value and a second drive value.

17. The process according to claim 12, further comprising the step of:

specifying a first setpoint value for regulating a current which flows through the pressure-regulating valve as a function of a second setpoint value for the fuel pressure.

18. The process according to claim 12, wherein the internal combustion engine has a common rail system.

19. The process according to claim 12, wherein the final controlling element and the pressure-regulating valve regulate the fuel pressure simultaneously.

* * * * *